United States Patent [19]

Rishel

[11] 4,090,342

[45] May 23, 1978

[54] METHOD OF PACKAGING AN EXTRUDABLE EXPLOSIVE COMPOSITION

[75] Inventor: James P. Rishel, McArthur, Ohio

[73] Assignee: Austin Powder Company, Beachwood, Ohio

[21] Appl. No.: 775,616

[22] Filed: Mar. 8, 1977

Related U.S. Application Data

[63] Continuation of Ser. No. 632,086, Nov. 14, 1975, abandoned.

[51] Int. Cl.[2] ..... B65B 53/02; B65B 9/06; B65B 11/16

[52] U.S. Cl. ..... 53/23; 53/28; 53/30 S; 102/24 R; 102/27 R

[58] Field of Search ..... 53/23, 28, 30 S, 33, 53/39, 184 S, 181, 182, 64; 102/24 R, 27 R

[56] References Cited

U.S. PATENT DOCUMENTS

| | | | |
|---|---|---|---|
| 2,801,180 | 7/1957 | Rumsey, Jr. | 53/30 S UX |
| 3,093,448 | 6/1963 | Kirkpatrick et al. | 53/30 S UX |
| 3,120,729 | 2/1964 | Niepmann | 53/64 |
| 3,127,273 | 3/1964 | Monahan | 53/30 S X |
| 3,307,324 | 3/1967 | Roehm | 53/181 |
| 3,321,886 | 5/1967 | Griffith et al. | 53/30 S |
| 3,367,266 | 2/1968 | Griffith | 102/27 R |
| 3,513,620 | 5/1970 | Billingsley et al. | 53/30 S X |

FOREIGN PATENT DOCUMENTS

| | | | |
|---|---|---|---|
| 1,186,331 | 4/1970 | United Kingdom | 102/24 |

*Primary Examiner*—Othell M. Simpson
*Assistant Examiner*—Horace M. Culver
*Attorney, Agent, or Firm*—Meyer, Tilberry & Body

[57] ABSTRACT

A method of packaging an extrudable explosive composition which includes extruding the explosive composition into an extrusion having a desired cross-sectional shape and size and shrinking a heat shrinkable plastic tube constructed around the extrusion to maintain the extruded cross-sectional shape and size of the extruded composition.

6 Claims, 10 Drawing Figures

FIG. 2
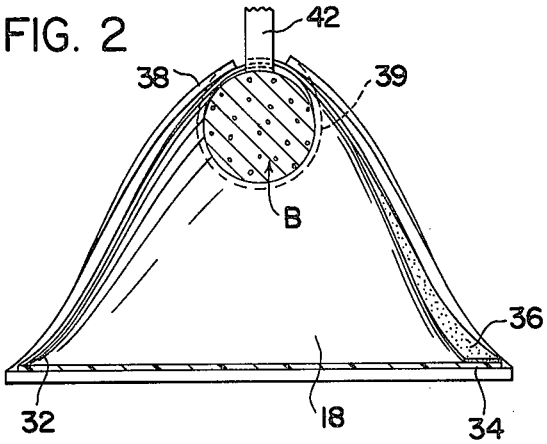
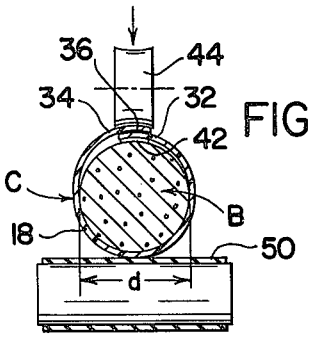
FIG. 3
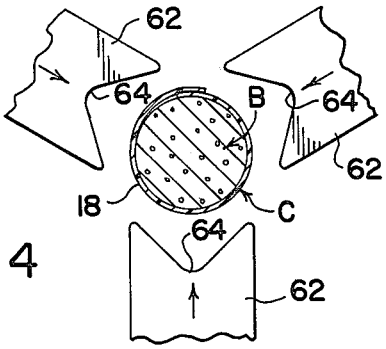
FIG. 4
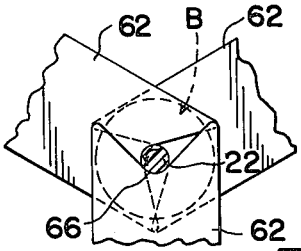
FIG. 4A
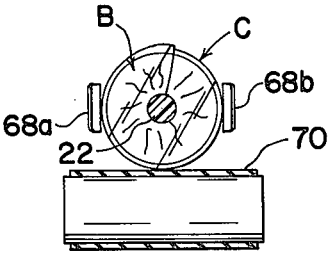
FIG. 5
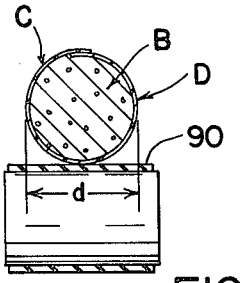
FIG. 6

METHOD OF PACKAGING AN EXTRUDABLE EXPLOSIVE COMPOSITION

This is a continuation of application Ser. No. 632,086, filed Nov. 14, 1975 and now abandoned.

This invention relates to the art of packaging explosives and more particularly to a method of packaging an extrudable explosive composition.

The invention is particularly applicable for packaging sensitized slurry type, extrudable explosive materials and it will be described with particular reference thereto; however, it is appreciated that the invention has more applications and may be used for packaging any extrudable explosive composition.

In producing elongated, generally cylindrical cartridges or packages of explosive compositions, it is quite common practice to formulate the ingredients in a mixer to produce a pliable mass. Thereafter, the resulting mass of explosive composition is extruded and packaged into cartridges or packages having the desired length and diameter to fit into bore holes, etc. These cartridges or packages have a preselected diameter which should be held within fairly close limits. A variety of materials have been used for providing the cylindrical package or container for the extruded explosive composition. For instance, plastic and cellulose materials have been used. These materials include polyethylene, ethyl cellulose, cellulose acetate, polypropylene, Teflon, Nylon, PVC, and polystyrene, to name a few. In addition, fibrous materials such as wood, paper, and cardboard have been waterproofed and used to form the cylindrical package or container for an extrudable explosive material. These plastic and fibrous containers or packages for extrudable plastic materials have been successful; however, the required processing substantially adds to the total cost of the resulting packaged explosive. In some instances, the packages have been preformed into somewhat fixed cylindrical shapes. In other techniques, the packages are bag-like and are expanded into a cylindrical shape by introduction of the extruded explosive. In either arrangement the explosive fills the container or package, which determines the final diameter of the explosive mass. By using these packaging techniques, the receptable or package is first formed and the extruded explosive composition is extruded into the receptacle or package. The explosive mass then expands into a shape determined primarily by the package. Generally, one end of the package is sealed by a metal clip or heat seal prior to filling of the receptacle or package. Thereafter, the other end is appropriately sealed. These operations require orienting of the package, forming the package, loading the package, and closing the package. Thus, the packaging of an extruded explosive composition is quite costly and requires a substantial amount of time and manpower.

The present invention relates to a method of packaging an extrudable plastic composition which produces a continuous processing operation requiring a minimum of product orientation and handling. The present invention allows generally continuous processing between the extruder and the finished packaged explosive.

In accordance with the present invention, there is provided a method of packaging an extrudable explosive composition having a processing temperature which generally should not be exceeded, said packaging method producing an elongated extrusion having the desired length, two spaced ends and a desired cross-sectional size. This method comprises the steps of extruding the explosive composition into an elongated extrusion having the desired cross-sectional size, and segmenting the extrusion into bodies each having the desired length while retaining the cross-sectional size over a major portion of the length of each body. A tube of heat shrinkable plastic film is provided around the extrusion. This tube has a cross-sectional shape matching the extrusion and a size at least slightly larger than the desired size of the final product. The extrusion and plastic tube are heated to a sufficient temperature to cause the tube to shrink into tight contact with the explosive, while the explosive retains the desired, extruded cross-sectional shape and size. By extruding the plastic material into the desired shape and size and then shrinking a heat shrinkable plastic tube around the explosive, the extrusion size determines the resulting external diameter of the packaged explosive material. In this manner, the diameter can be quite closely controlled at the extruder and need not be determined by the shape of the receiving receptacle or container which, in the past, has been somewhat difficult to produce to close tolerances. The extruded size of the explosive material is essentially the final size of the packaged explosive material. Thus, by providing an accurate extrusion opening, which can be done quite conveniently, an accurately dimensioned packaged explosive is obtained.

In accordance with another aspect of the present invention, it is generally desirable to maintain the extruded explosive below a certain processing temperature. To assure this desired feature, the plastic encircled explosive is passed through a heating zone at a rate sufficient to heat the shrinkable plastic tube to only the desired shrink temperature. The explosive itself within the plastic tube remains at a relatively low temperature which is below a maximum selected known processing temperature. Of course, the external skin portion of the extruded explosive is heated somewhat; however, this heating will not increase the sensitivity of the bulk explosive. Appreciable increased sensitivity of the explosive requires elevation of a major portion of the explosive extrusion which does not occur during the heat shrinking operation. Accurate control of the shrink zone temperature and the speed at which the explosive and heat shrinkable plastic tube pass through the heating zone causes heating of the shrinkable plastic film only. This causes the film to shrink, or contract, tightly around the extruded explosive material without substantial heating of the explosive mass.

By using the heat shrinkable package concept, the extrusion operation can be continuous with the shrinkable film being placed or wrapped around the extrusion at the outlet or nozzle of a standard explosive extruder. Thereafter, the plastic wrapped or encircled explosive extrusion can be segmented or cut into the desired length by any appropriate arrangement, such as by twisting the plastic film at spaced locations. This illustrative operation displaces the explosive material in the twisted area to form individual sections of explosives defined between two spaced twisted positions. This twisted operation compresses the explosive radially and seals the plastic film at opposite ends of the resulting individual bodies of explosive. This produces a convenient arrangement for closing the ends of the packaged explosive. Of course, solvent seals, heat seals, wire clips or other appropriate seals for the plastic wrapping or tube could be used at the opposite ends of the separated explosive bodies without departing from the intended spirit of the invention.

The primary object of the present invention is the provision of a method of packaging an extrudable explosive material or composition into cylindrical packages, which method reduces the handling and processing time for the packaging operation.

Another object of the present invention is the provision of a method as defined above, which method provides improved dimensional stability for the resulting cylindrical packages.

Yet another object of the present invention is the provision of a method, as defined above, which method uses a heat shrinkable plastic film as the packaging media of the extrudable explosive.

Still a further object of the present invention is the provision of a method, as defined above, which method allows the resulting explosive to retain the extruded dimension, instead of expanding into a shape determined primarily by a presized tube or container.

These and other objects and advantages will become apparent from the following description taken together with the accompanying drawings in which:

FIG. 2 is an enlarged cross-sectional view taken generally along line 2—2 of FIG. 1;

FIG. 3 is an enlarged cross-sectional view taken generally along line 3—3 of FIG. 1;

FIG. 4 is a partial enlarged cross-sectional view taken generally along line 4—4 of FIG. 1;

FIG. 4A is a view similar to FIG. 4 showing a processing operation;

FIG. 5 is an enlarged cross-sectional view taken generally along line 5—5 of FIG. 1A;

FIG. 6 is an enlarged cross-sectional view taken generally along line 6—6 of FIG. 1B; and, FIG. 7 is a top plan view illustrating a portion of the structure shown in FIGS. 1 and 1A.

Figures 1, 1A, 1B:
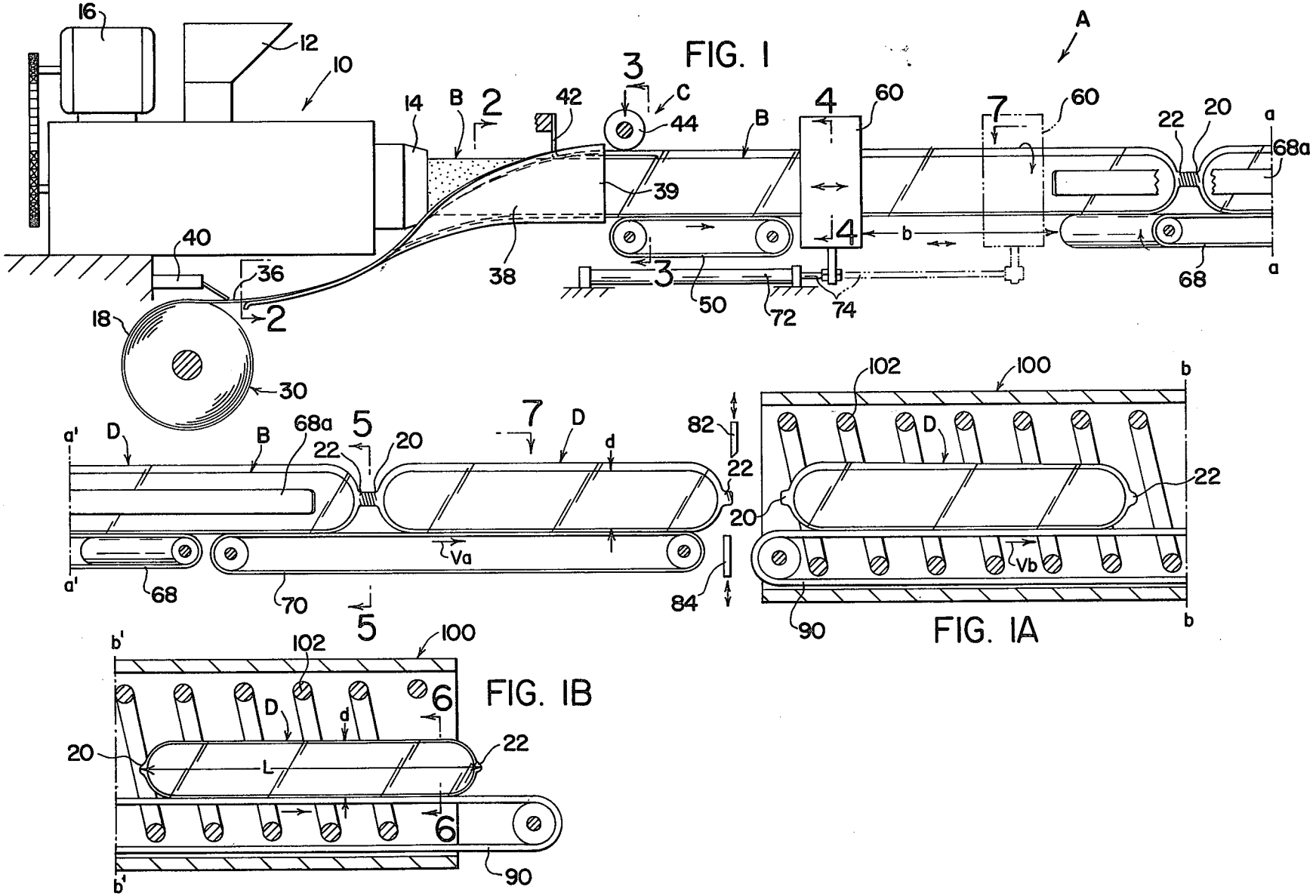
FIGS. 1, 1A and 1B are segmented views taken together to show a schematic flow diagram of the present invention.
Figure 7:
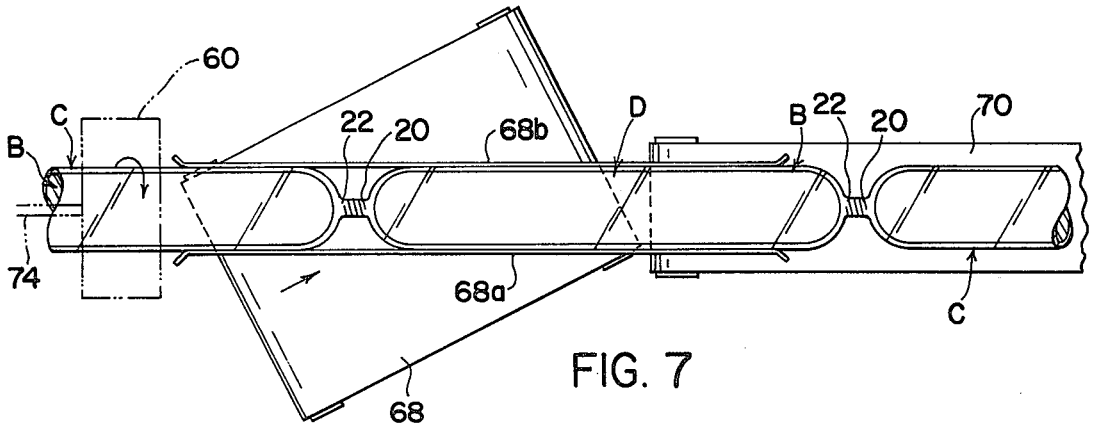

Referring now to the drawings wherein the showings are for the purpose of illustrating a preferred embodiment of the invention only, and not for the purpose of limiting same, FIGS. 1, 1A and 1B show a packaging line A for packaging or wrapping extrudable plastic explosive material or composition. The extrudable explosive may take a variety of forms, such as water bearing ammonium nitrate slurry with a sensitizer or gelatin dynamite, to name only two. In the explosive art various types of explosives are extruded into cylindrical shapes and then packaged into appropriate containers or packages for subsequent use. These packages, which are generally cylindrical, must assure a certain diameter for the packaged explosives. In accordance with the illustrated embodiment of the invention, an extruder 10 includes an explosive material inlet 12 and an outlet nozzle 14. An extrusion B, having a desired diameter *d*, is forced from nozzle 14 by a normal feed mechanism driven by a motor 16. Around the extrusion B there is provided an envelope, tube or wrapping C formed from a plastic film 18. This envelope, tube or wrapping C holds the extrusion in a generally cylindrical configuration. Subsequently, the film encircled extrusion is formed into cylindrical packages D each having a selected length L and basically the same diameter *d* as the original extrusion. In accordance with the preferred embodiment of the invention, the outer diameter of package D is the diameter of the extrudable explosive material as it exits from extruder nozzle 14. The plastic envelope, tube or wrapping C holds the extruded explosive in this shape and retains the size as defined by the extruder. Each packaged explosive D has spaced ends 20, 22 which are closed by the plastic films. In the illustrated embodiment package D is closed by a twisting plastic film 18 which also squeezes the explosive material at ends 20, 22. Of course, heat seals, metal ties or other similar known sealing arrangements could be used to tie tube C at ends 20, 22.

Referring now to the plastic film 18 forming the envelope, tube or wrapping C which surrounds extrusion B, this plastic film has a thickness of approximately 1 mil and is supplied from a reel 30 positioned adjacent to nozzle 14. Plastic film 18 is heat shrinkable. When the film is heated to the general range of 100° -250° F, the film shrinks in a transverse direction between 20% and 30%. The film is oriented to have only minor shrinkage in the machine or longitudinal direction. Heat shrinkable plastic film is available with various characteristics. Several of these heat shrinkable plastic materials could be used in practicing the invention. Krystaltite film produced by the Plastic Film Systems Division of Allied Chemical is used in the preferred embodiment. This heat shrinkable plastic film is polyvinylchloride film having a tensile strength in the general range of 100,000–200,000 psi and a heat sealing temperature of 300° -350° F. Such film can be purchased with between 10–45% shrinkage in either of the two orthogonal directions. In practice, substantial shrinkage in only the transverse direction is desired. Film 18 can be heat sealed or solvent sealed along a longitudinal seam to form a tube surrounding extrusion B. Other arrangements can be used to form the film around the extrusion. In the illustrated embodiment of the invention, film 18 from reel 30 includes edges 32, 34, and a solvent 36 is applied along edge 34. This can be done by an applicator 40. By an appropriate guiding arrangement, schematically shown as a guide plate 38, the edges 32, 34 are overlapped at the exit nozzle 14 of extruder 10, as best shown in FIG. 3. Guide plate 38 has an orifice 39 through which the wrapped extrusion is drawn by conveyor 50. Of course, any appropriate guiding mechanism can be used for the schematically illustrated guide plate. Solvent 36 is located between the surfaces of overlapped edges 32, 34 to form a longitudinal joint or seam. A pressure roll 44 exerts pressure between edges 32, 34 and against an internal anvil 42 extending a short distance from nozzle 14 toward the exit direction of extrusion B. In this manner, a tube of heat shrinkable plastic film is loosely formed around the extrusion B as the extrusion exits from nozzle 14. Thereafter, conveyor 50 carries extrusion B, with the encircling heat shrinkable plastic tube C, therearound, away from nozzle 14 at a speed corresponding to the extrusion speed of extruder 10. Plastic film tube C is loosely positioned around the extrusion B, as shown in FIG. 4. The gap between the plastic film 18 and extrusion B is shown in FIG. 4. This gap is quite small so that film 18 is contracted against extrusion B by subsequent heating. In practice, there is very little spacing between the film and the extrusion at the exit of extruder 10 so that subsequent heating forms a tight, film pressure exerting surface junction between the film and the explosive. In other words, the gap is such that the percentage of shrinkage created by subsequent heating is sufficient to form a firm contact to hold the extrusion B in basically the same shape and size as extrusion B. Plastic film 18 could be provided over extrusion B by a variety of other mechanisms. In one mechanism, a heat sealed londitudinal seam could be created. A sprial seam, either heat sealed or solvent sealed, could be provided. In addition, film 18 could be wrapped transversely around extrusion B. Irrespective of the manner of obtaining the heat shrinkable plastic tube C around extrusion B, the extrusion is ultimately formed into a package D by shrinking the encircling tube against the explosive.

In the illustrated embodiment, a compressing and twisting head 60 squeezes extrusion B at axially spaced positions to create a length L for the resulting package D. The wrapped extrusion is compressed to form individual bodies. In the illustrated embodiment anvils 62 of head 60 have circular recesses 64 that combine to produce a circular opening 66 which is sufficiently small to squeeze the explosives from the area between the segmented extrusion. When anvils 62 move inwardly, recesses 64 squeeze the explosives to form a neck of plastic. The neck of plastic film 18 is twisted by a rotating extrusion B or the neck itself. This could be done by rotating anvils 62. In the illustrated embodiment angularly positioned conveyor 68 twists the total extrusion as it progresses along guide rails 68*a* and 68*b*. This twisted portion may be heated by head 60 to produce a further joint of film at ends 20, 22. In addition, metal ties could be used without twisting the plastic. However, in the preferred embodiment the plastic film is twisted by rotating anvils 62 or by the conveyor 68 to produce the joint between ends 20, 22. These joints produce the individual packages D which are conveyed on a conveyor 70 operating at a velocity $V_a$. This velocity corresponds with the velocity of conveyors 50 and 68 so that extrusion B can move through packaging line A at a uniform speed. Mechanism 60 may move with extrusion B to allow continuous movement of extrusion B. To allow for movement of mechanism 60, a spacing *b* is provided between the left hand position of mechanism 60 and conveyor 68. Thus, movement along the arrows indicated at the lower right hand portion of mechanism 60 is possible by an appropriate synchronizing control, shown as cylinder 72 and rod 74. Thus, when the mechanism 60 starts its compressing and twisting operation, it moves with extrusion B until the end closing operation is completed. Thereafter, the packages D are formed, as shown at the right of mechanism 60, and anvils 62 release from one joint and shift to the left to form the next joint between the individual packages. A variety of structures could be used for providing this joint between packages D.

At the exit end of conveyor 70, there is provided an appropriate cutoff or severing arrangement for separating the individual explosive packages D. This arrangement could take a variety of forms one of which is schematically illustrated as reciprocating blades 82, 84. After being cut in the individual packages, the plastic wrapped explosives are deposited on conveyor 90 which extends through a radiant heated muffle 100 having a resistance heating element 102. Conveyor 90 moves at a velocity $V_b$ which is correlated to the temperature of the muffle 100 so that the film 18 of tube C is heated to the desired temperature for shrinking the film into tight contact with the extrusion B. However, the heating duration or residence time of muffle 100 is sufficiently short to prevent undue heating of the explosive material of extrusion B. Such heating could make the explosive more sensitive than desired for a processing operation. In practice, the muffle heats the film 18 to approximately 100° -150° F while the explosive within the package D is retained at a temperature substantially below 100° F. Thus, only the outer plastic film is heated to shrink the plastic film into tight contact with the explosive material formed into a cylindrical body having a diameter *d*. This diameter is essentially the same diameter as the diameter of extrusion B coming from the extruder 10. Thus, the diameter of package D is controlled by the extruder and not by the internal diameter of a preformed container, or package, as has been the practice in the past. As can be seen, packaging line A is a continuous line with no intermediate handling of the explosive material until the final package D has been formed. This is a substantial advance over packaging lines heretofore used in producing cylindrical bodies of extrudable explosive material.

Various heat shrinkable material can be used in various thicknesses and with different parameters as long as the resulting heating operation shrinks the heat responsive film into tight contact with the previously extruded explosive material to form a cylindrical package.

Having thus described the invention, it is claimed:

1. A method of packaging an extrudable explosive composition having a processing temperature which generally should not be exceeded, to produce an elongated body having a desired length, two spaced ends and a desired cross-sectional size, said method comprising the steps of:

(a) extruding said explosive composition in an elongated extrusion having said desired cross-sectional size and an exposed outer peripheral surface formed from said explosive composition;

(b) providing a heat shrinkable plastic sheet around said extrusion and in direct contact with said outer peripheral surface;

(c) closing said plastic sheet at positions along said extrusion corresponding to said desired length;

(d) severing said plastic sheets at said positions to produce separate bodies of wrapped, extruded explosive compositions; and, (e) passing said bodies through a heating zone at a selected temperature above said processing temperature and at a rate to heat said plastic sheet to a shrink temperature substantially higher than said processing temperature while said bodies of explosive composition are heated to a temperature below said processing temperature whereby said plastic sheet shrinks into tight contact with said outer peripheral surfaces of said bodies while said cross-sectional size is retained.

2. A method as defined in claim 1 wherein said processing temperature is about 100° F.

3. A method as defined in claim 1 wherein said selected temperature is in the range of 100° F to 250° F.

4. A method of packaging an extrudable explosive composition having a processing temperature which generally should not be exceeded, to produce an elongated body having a desired length, two spaced ends and a desired cross-sectional size, said method comprising the steps of:

(a) extruding said explosive composition in an elongated extrusion having said desired cross-sectional size and an exposed outer peripheral surface formed from said explosive composition;

(b) providing a heat shrinkable plastic sheet around said extrusion and in direct contact with said outer peripheral surface;

(c) closing said plastic sheet at positions along said extrusion corresponding to said desired length to form said extrusion into separate bodies; and, (d) then passing said bodies through a heating zone at a selected temperature above said processing temperature and at a rate to heat said plastic sheet to a shrink temperature substantially higher than said processing temperature while said bodies of explosive composition are heated to a temperature below said processing temperature whereby said plastic sheet shrinks into tight contact with said outer peripheral surface of said bodies while said cross-sectional size is retained.

5. A method as defined in claim 4 wherein said processing temperature is about 100° F.

6. A method as defined in claim 4 wherein said selected temperature is in the range of 100° F to 250° F.

* * * * *